US008132792B2

(12) United States Patent
Perris

(10) Patent No.: US 8,132,792 B2
(45) Date of Patent: Mar. 13, 2012

(54) TEMPORARY GUARD RAIL SUPPORT

(75) Inventor: Kevin Perris, Alberta Beach (CA)

(73) Assignee: Safety In A Second Ltd., Ottawa (CA)

( * ) Notice: Subject to any disclaimer, the term of this patent is extended or adjusted under 35 U.S.C. 154(b) by 705 days.

(21) Appl. No.: 11/913,742

(22) PCT Filed: May 5, 2006

(86) PCT No.: PCT/CA2006/000718
§ 371 (c)(1),
(2), (4) Date: Jul. 30, 2008

(87) PCT Pub. No.: WO2006/119613
PCT Pub. Date: Nov. 16, 2006

(65) Prior Publication Data

US 2009/0159864 A1 Jun. 25, 2009

(30) Foreign Application Priority Data

May 9, 2005 (CA) ..... 2506928

(51) Int. Cl.
*E04G 5/14* (2006.01)

(52) U.S. Cl. ..... 256/65.14; 256/65.06; 256/DIG. 6; 182/82; 182/113

(58) Field of Classification Search ..... 256/59, 256/65.02, 65.03, 65.04, 65.05, 65.06, 65.14, 256/DIG. 6, 64; 52/296, 297; 182/82, 113
See application file for complete search history.

(56) References Cited

U.S. PATENT DOCUMENTS 580,311 A * 4/1897 Hammett ..... 256/64
3,480,257 A * 11/1969 Bourn et al. ..... 256/59
3,589,682 A * 6/1971 Dickey ..... 256/59
3,776,521 A * 12/1973 Weinert ..... 256/59
3,995,833 A * 12/1976 McLaughlin et al. ..... 256/59
4,787,475 A 11/1988 Arteau et al.
4,830,341 A * 5/1989 Arteau et al. ..... 256/65.14
4,979,725 A * 12/1990 Hutchings, II et al. ..... 256/64
5,314,167 A 5/1994 Holloman
5,431,372 A 7/1995 Kostelecky
5,456,451 A 10/1995 Eyler
5,573,227 A 11/1996 Hemauer
5,647,451 A 7/1997 Reichel
5,711,398 A 1/1998 Bartholomew
5,896,944 A 4/1999 Mcmillian
(Continued)

FOREIGN PATENT DOCUMENTS

CA 917972 1/1973
(Continued)

*Primary Examiner* — Michael P Ferguson
(74) *Attorney, Agent, or Firm* — Cassan MacLean

(57) ABSTRACT

A guard rail support and assembly is disclosed for use in providing a safe work area for workmen working at dangerous heights, particularly in the construction industry. The guard rail support assembly comprises a plurality of guard rail supports arranged in a spaced fashion and wooden guard rails extending between and attached on either end to each support. Each guard rail support comprises an attachment base having quick fastening means for quick attachment and release of the support to a ground surface of the site under construction, a plurality of rail supports having quick fastening means for quick attachment and release of the wooden guard rails and a fall-protection or tarp tie-off ring. Advantageously, a portable and lightweight guard rail assembly may be constructed with the guard rail supports in an expedient and efficient manner to provide safe, unobstructive protection against falls.

16 Claims, 6 Drawing Sheets

U.S. PATENT DOCUMENTS

| | | | | |
|---|---|---|---|---|
| 6,003,629 | A | 12/1999 | Clouthier | |
| 6,015,139 | A * | 1/2000 | Weber | 256/65.14 |
| 6,038,829 | A | 3/2000 | Franks | |
| 6,039,150 | A | 3/2000 | Palmer | |
| 6,053,281 | A | 4/2000 | Murray | |
| 6,220,577 | B1 * | 4/2001 | Ostrow | 256/65.14 |
| 6,336,623 | B1 | 1/2002 | McCarthy | |
| 6,679,482 | B2 | 1/2004 | Allenbaugh | |
| 2006/0249721 | A1 * | 11/2006 | Landaker et al. | 256/59 |

FOREIGN PATENT DOCUMENTS

| | | |
|---|---|---|
| CA | 917973 | 1/1973 |
| CA | 1026604 | 3/1975 |
| CA | 1013981 | 7/1977 |
| CA | 1299002 | 4/1992 |
| CA | 2162526 | 9/1996 |
| CA | 2206676 | 8/1997 |
| CA | 2237418 | 6/1999 |
| CA | 2393092 | 11/2000 |

* cited by examiner

TEMPORARY GUARD RAIL SUPPORT

FIELD OF THE INVENTION

The present invention relates to a portable, temporary guard rail support and, more particularly, to a novel guard rail support for use in the erection of a safety barrier or fence at sites under construction such as office buildings, high rise apartments or the like.

BACKGROUND TO THE INVENTION

Modern construction techniques, particularly those commonly employed in high rise apartment and office building construction, require that safety barriers or guard rails be erected around the perimeter of all uncompleted floors (i.e. along the drop-off edges of concrete floor slabs) for two reasons: Firstly, personal safety requires the erection of at least a single rail at about waist height around the exterior of such uncompleted floors. Secondly, it is also necessary that a retaining kick board be erected at floor level so as to prevent the accidental dislodgement of articles which would otherwise cause a substantial safety hazard to workmen on the floors below and around the construction site. In certain cases, the provision of a weather barrier, such as a plastic tarpaulin or the like, may be necessary so as to protect the site under construction as well as workmen from inclement weather conditions.

The general practice in the erection of such safety barriers involves the use of lengths of lumber stock such as long boards of the 2"×4" variety (commonly referred to as "two-by-fours"). Such boards are cut to length and then nailed together in varying patterns in order to provide the desired guard railings. After such railings have served their purpose they are knocked down, the longer boards typically reserved for future use in the piecing together of future guard railings. The shorter boards are not always reusable. Furthermore, the longer lengths of lumber frequently become damaged by splitting or otherwise due to the application thereto of repeated impact blows and different nail placements. While such makeshift such guard railings meet safety requirements, they require more than one person and a fair amount of time to construct and often result in the destruction of the materials used when they are disassembled after completion of work at a construction site. Obviously, the additional labour and cost of materials used will add to the expense of the job. Many such railings also fail to pass the rigidity requirements of safety inspectors.

As a result, various structures have been proposed to aid in the construction of temporary safety barriers which prevent workmen from accidental falls and which meet strict safety guidelines. To a large extent, however, most of the proposed structures are impractical, expensive and too complicated to use. Furthermore, structures that are too complicated to use will not be used efficiently and/or properly by workmen at a construction site, thereby posing a safety risk.

Consequently, a need exists for a portable and simple guard rail system which is effective in preventing accidental falls, meets safety guidelines and which can be assembled and disassembled in an efficient manner.

SUMMARY OF THE INVENTION

A portable guard rail support and assembly for use in erecting a safety barrier to provide a safe work area for workmen working at dangerous heights, particularly in the construction industry, is provided.

In accordance with a first aspect of the present invention, a guard rail support for use in erecting a temporary safety barrier is provided wherein the guard rail support comprises a substantially flat bottomed base plate, an upright column affixed to the flat bottomed base plate, at least one guard rail support bracket affixed to the upright column, a kick board retaining flange affixed to the flat bottomed base plate in spaced proximal relationship to the upright column, an angular brace affixed to the upright column and the flat bottomed base plate and a safety tie-off ring affixed to the upright column and the flat bottomed base plate.

In accordance with a further aspect of the present invention, a concrete-filled steel base is also provided that is adapted to receive the portable guard rail support in circumstances where anchoring of the portable guard rail support to a floor or ground surface is not possible. The concrete-filled steel base has a retaining groove formed in a bottom surface thereof for slidably receiving the substantially flat bottomed base plate of the portable guard rail support. The steel base further comprises a channel integrally formed therein extending from a top surface of the steel base to the retaining groove and wherein the channel is in perpendicular relation to the retaining groove and dimensioned so as to be able to receive at least one kick-board.

In accordance with another aspect of the present invention, a portable safety barrier for use about a drop-off edge of a floor surface is provided comprising at least first and second portable guard rail supports located in spaced relation to one another along the drop-off edge and wherein each of the at least first and second portable guard rail supports comprises a substantially flat bottomed base plate, an upright column affixed to the substantially flat bottomed base plate, at least one guard rail support bracket affixed to the upright column, a kick board retaining flange affixed to the substantially flat base plate in spaced proximal relationship with the upright column, an angular brace affixed to the upright column and the substantially flat bottomed base plate, a safety tie-off ring affixed to the upright column and the substantially flat bottomed base plate, and wherein the at least one guard rail support bracket and the retaining flange of the at least first and second portable guard rail supports fixedly retain guard rails and kick boards.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

A better understanding of the invention will be obtained by considering the detailed description below, with reference to the following drawings in which.

DETAILED DESCRIPTION

Figure 1:
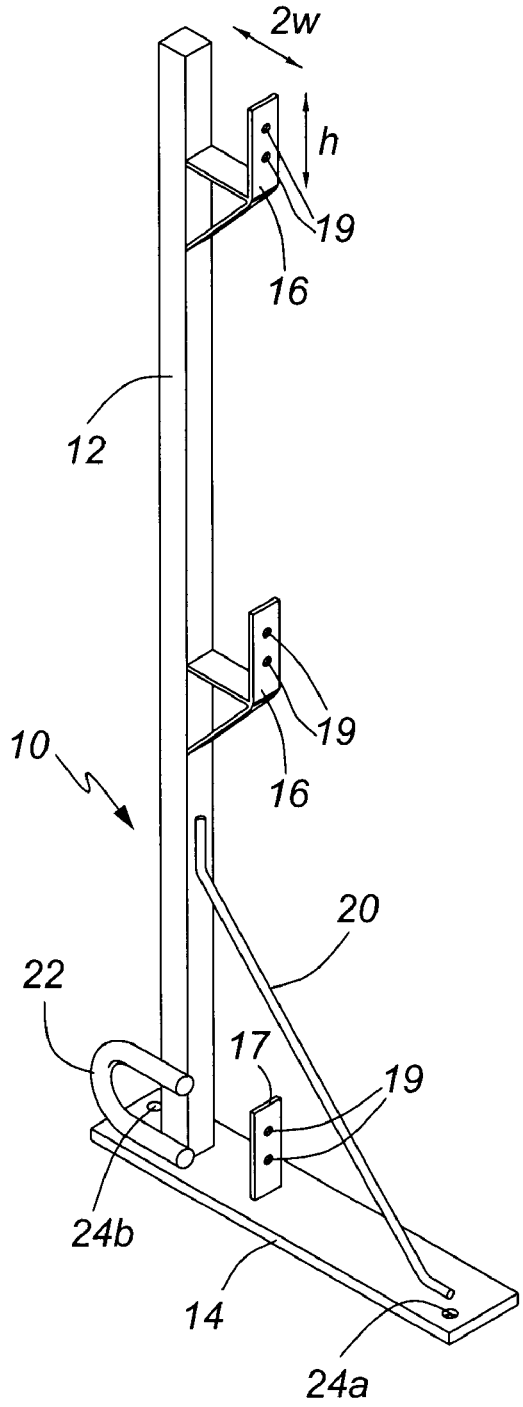
FIG. 1 is a front perspective view of a portable guard rail support in accordance with the present invention.

Throughout the following detailed description, the same reference numerals are used to denote the same features in all of the drawings.

Figure 2:
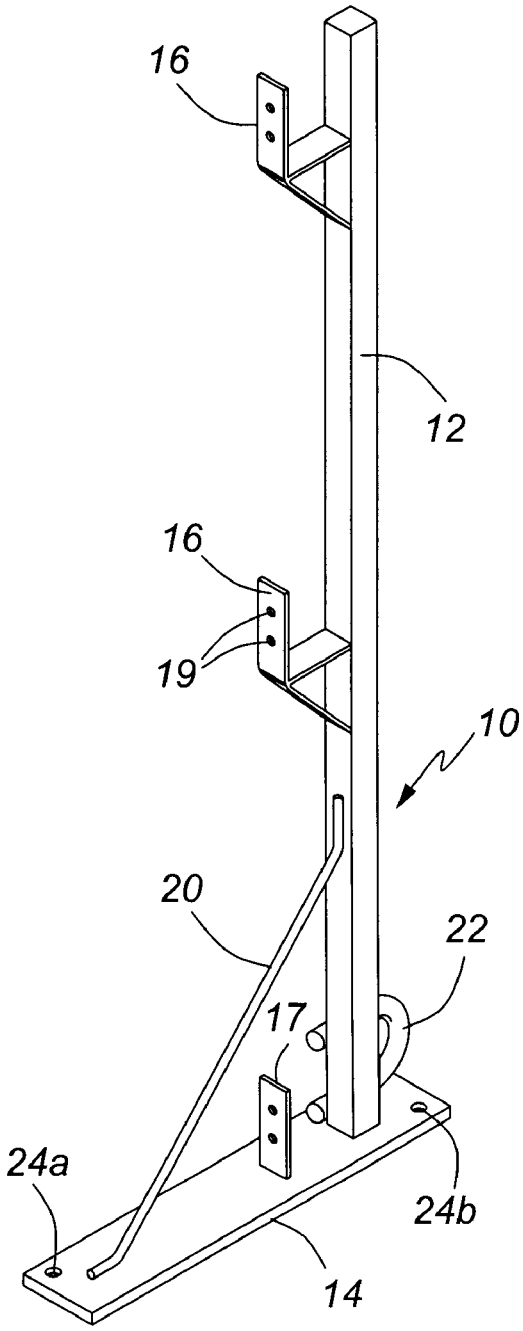
FIG. 2 illustrates a rear perspective view of the portable guard rail support according to FIG. 1.

FIGS. 1 and 2 depict front and rear isometric views, respectively, of a guard rail support 10 according to a preferred aspect of the present invention. The guard rail support 10 consists of a rectangular upright column 12, the lower end of which is affixed to a substantially flat rectangular metallic base plate 14 in a central symmetric axis thereof. The flat base plate 14 is provided with at least two bores or holes 24*a* and 24*b* for receiving suitable fastening means (not shown) in order to anchor or secure the guard rail support 10 to a floor or ground surface (not shown). In a preferred embodiment, the fastening means comprises expansion anchors well known to those skilled in the art. However, any suitable fastening means (e.g. screws) may be used. First and second L-shaped rail supporting brackets 16 are affixed one above the other to the upright column 12 as shown to provide supporting means for wooden guard rails (not shown). A retaining flange 17, spaced apart from the upright column 12, is affixed to the baseplate 14 of the guard rail support 10 in order to receive and secure a kick board (not shown) in position. The rail supporting brackets 16 and the retaining flange 17 have bores 19 formed therein for receiving fasteners to secure wooden guard rails within the rail supporting brackets 16 and the retaining flange 17. An angle brace 20 is affixed between the upright column 12 and the base plate 14 in the manner shown to provide for structural stability of the guard rail support 10. Finally, a fall protection (or safety) tie-off ring 22 is affixed to the lower end of the upright column 12 and to the base plate 14.

Preferably, the L-shaped rail supporting brackets 16 and retaining flange member 17 are dimensioned to accommodate two adjacent, overlapping wooden rails which may be secured to each other and within the brackets 16 and retaining flange 17 by suitable fastening means such as nailing or the like. In a preferred embodiment, the wooden rails would be comprised of stock lumber such as lengths of two-by-four (2×4). In this case, the brackets would be dimensioned so as to accommodate two 2×4's i.e. a width, 2w, of 4 inches and a height, h, of at least 4 inches. Thus, it may be seen that the rail supporting brackets 16 and retaining flange 17 may be dimensioned in any appropriate manner, 2w×h, to accommodate any size, w×h, of stock lumber desired.

In order to implement a guard rail assembly (safety barrier) at a construction site according to a first aspect of the invention, a plurality of guard rail supports 10 are located at set distances apart (preferably slightly less than the length of stock lumber to be used for the guard rails) along the outer edge or perimeter of a floor undergoing construction. The guard rail supports 10 are secured to the floor via suitable fasteners driven through the bores 24*a*, 24*b* formed in the base plate 14 of each guard rail support 10. Lengths of stock lumber (at least spanning the distance between the corresponding rail supporting brackets 16 and retaining flanges 17 of consecutively aligned guard rail supports 10) may then be positioned and secured within the corresponding rail supporting brackets 16 and retaining flanges 17 of adjacent guard rail supports 10 so as to form a guard rail assembly (safety barrier) consisting of upper and lower wooden guard rails and a kick board. The configuration of such a guard rail assembly is discussed further in relation to FIG. 4.

As seen in FIGS. 1 and 2, the fall protection tie-off (safety) ring 22 has the preferred shape of a sideways "U" with one end portion affixed to the lower end of the upright column 12 and the other end affixed to the base of the upright column 12 and the flat base plate 14. The fall protection tie-off ring 22 provides for numerous advantages. Firstly, the fall protection tie-off ring 22 may serve as retaining and attachment means for a safety cable which is frequently used by workers at sites undergoing construction. In this respect, a continuous safety cable may be run through the fall protection tie-off rings 22 of consecutively aligned guard rails supports comprising a guard rail assembly (see FIG. 4) constructed in accordance with the present invention. A workman may then "tie off" to such a safety cable at any desired location thereby providing protection from accidental falls. Alternatively, a workman may tie off to the actual fall protection tie-off ring 22 of an individual guard rail support 10, if desired. Secondly, the fall protection tie-off rings 22 of individual guard rail supports 10 comprising a guard rail assembly may be used to fasten weatherproof tarpaulins or the like (not shown) to protect workmen and the site under construction from inclement weather conditions.

Figure 3:
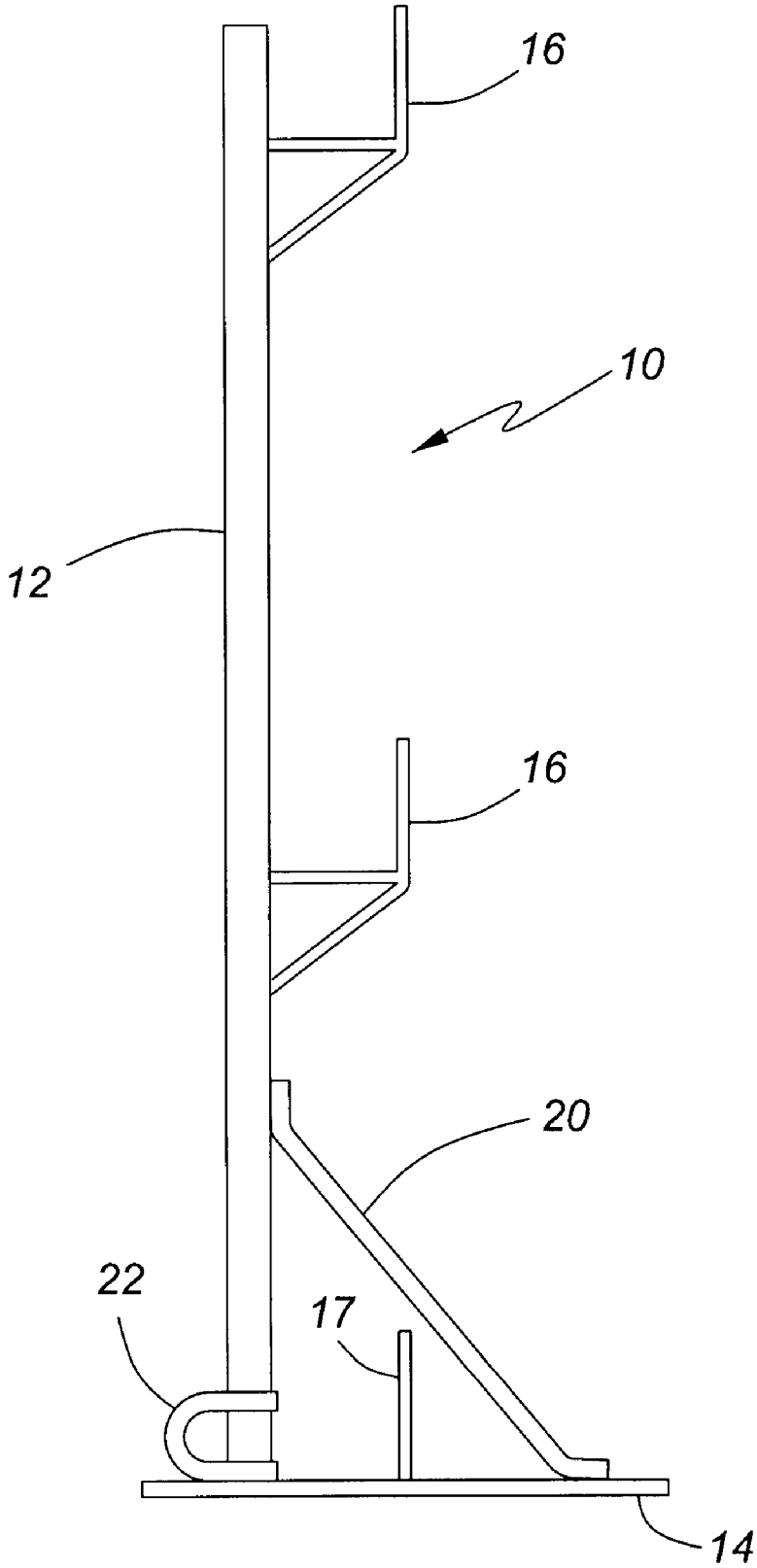
FIG. 3 is a side view of the portable guard rail support according to FIG. 1.

FIG. 3 is a side view of the guard rail support 10 in FIGS. 1 and 2 wherein like features are denoted by like numerals.

Figure 4:
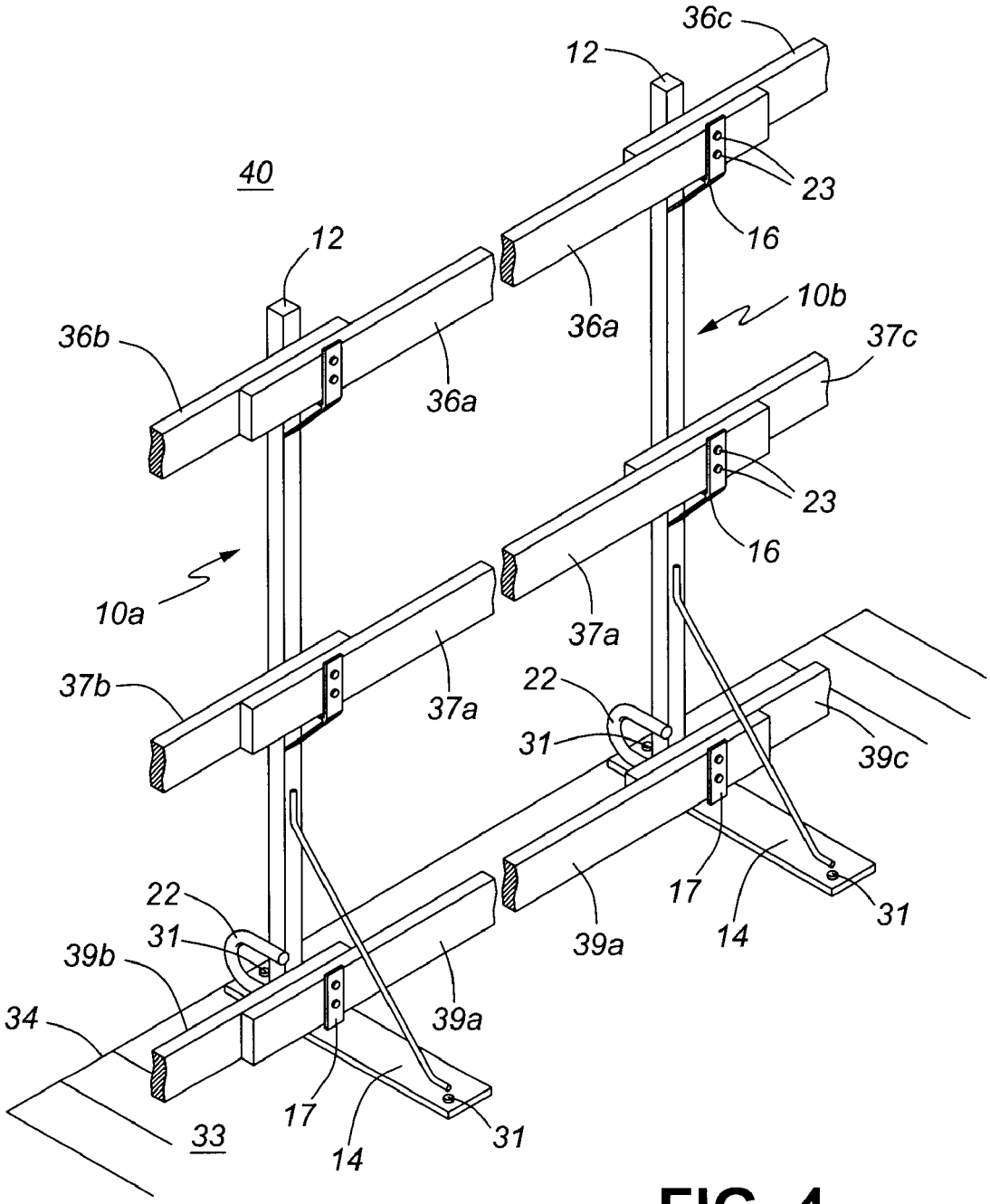
FIG. 4 depicts a portion of a safety barrier constructed with overlapping wooden guard rails in accordance with a preferred embodiment of the present invention.

FIG. 4 depicts a portion of a guard rail assembly or safety barrier 40 assembled along the perimeter of a floor 33 under construction in accordance with one aspect of the present invention. In FIG. 4, first and second guard rail supports 10*a* and 10*b* are located at a set distance d apart and secured along an outer floor edge 34 via expansion anchors 31 driven through the corresponding bores 24*a*, 24*b* of each guard rail support 10*a*, 10*b* into the floor 33. Upper and lower wooden rails 36*a* and 37*a*, (e.g. suitable lengths of 2×4) span at least the distance between corresponding rail supporting brackets 16 on the guard rail supports 10*a*, 10*b*. Similarly, kick board 39*a* spans at least the distance between the retaining flanges 17 on the guard rail supports 10*a*, 10*b*. In a preferred embodiment, the distance d between guard rail supports 10*a* and 10*b* is slightly less than the lengths of 2×4 comprising the wooden rails such that the upper and lower wooden rails 36*a*, 37*a* and kick board 39*a* will have some overshoot at each rail supporting bracket 16 or retaining flange 17.

Considering guard rail support 10*a*, upper and lower wooden rails 36*a*, 37*a* and kick board 39*a* are secured with overlapping wooden rails 36*b*,37*b* and 39*b* within the corresponding rail supporting brackets 16 and retaining flange 17 via suitable fasteners 23 placed through bores 19. Suitable fasteners 23 may include nails, screws, rivets or the like. Similarly, upper and lower wooden rails 36*a*, 37*a* and kick board 39*a* are secured with overlapping wooden rails 36*c*,37*c* and 39*c* within the corresponding rail supporting brackets 16 and retaining flange 17 of guard rail support 10*b* via suitable fasteners 23 placed through corresponding bores 19. As shown, the left end of upper wooden rail 36*a* overlaps with the right end of upper wooden rail 36*b* at the uppermost rail supporting bracket 16 of the first guard rail support 10*a*. Similarly, the right end of upper wooden rail 36*a* overlaps with the left end of upper wooden rail 36*c* at the uppermost rail supporting bracket 16 of the second guard rail support 10*b*. It should be understood that the configuration described above for the upper wooden rails 36 holds for lower wooden rails 37 and kick boards 39. It will further be appreciated that upper wooden rails 36*b* and 36*c*, lower wooden rails 37*b* and 37*c* and kick board 39*b* and 39*c* span the distance to other respective guard rail supports 10 (not shown) and may be secured within the corresponding rail supporting brackets and retaining flanges of the other guard rail supports 10 in the same manner as described above.

Figure 5:
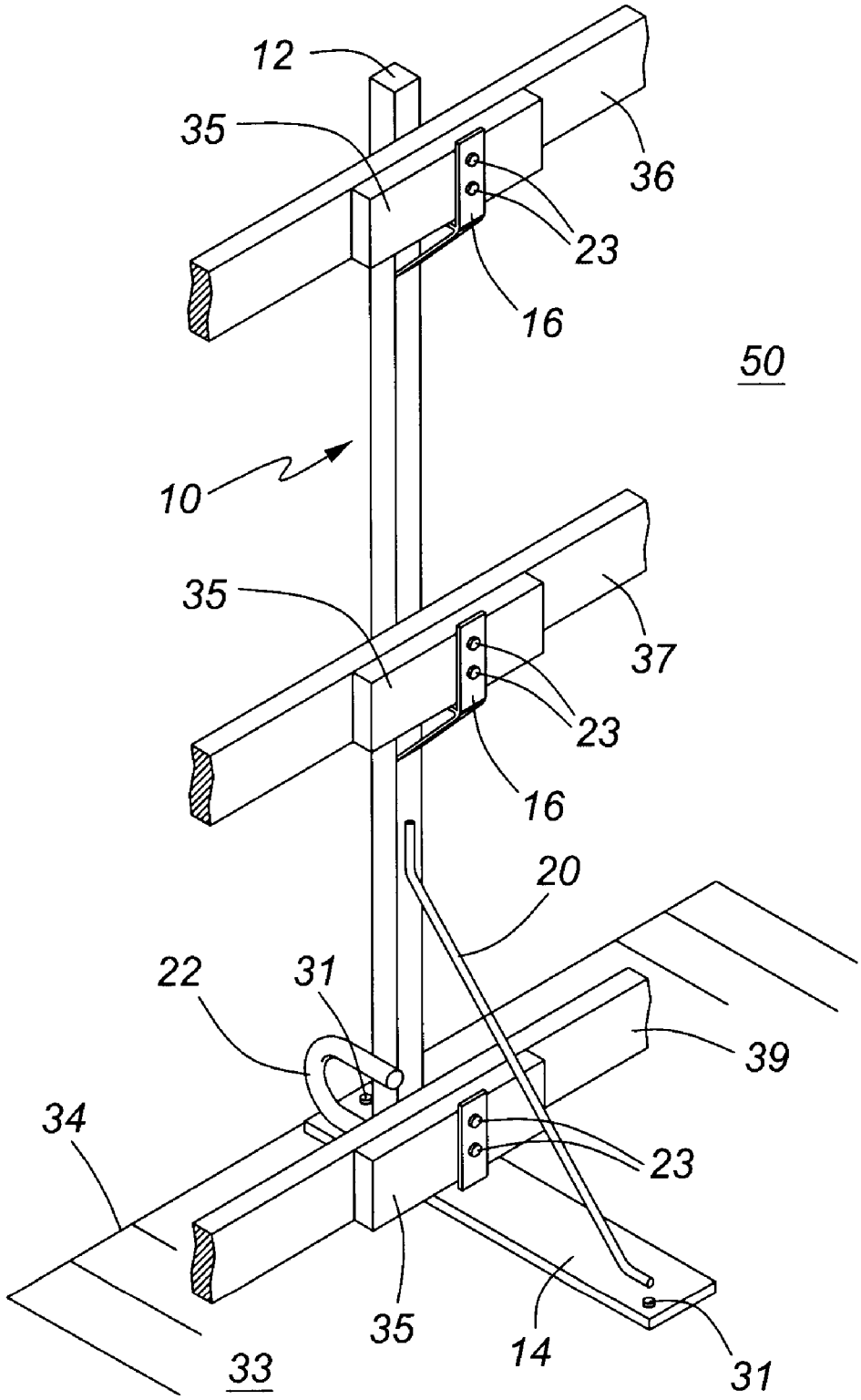
FIG. 5 depicts a portion of a safety barrier constructed with wooden guard rails in accordance with another embodiment of the present invention.

In cases where it is not desired or possible to use the overlapping wooden rail scheme depicted in FIG. 4, for whatever reason, an alternative configuration may be used at each guard rail support 10 of the present invention to construct a safety barrier 50 as shown in FIG. 5. In this case, a short stub 35 of the same stock lumber used for the wooden guard rails (e.g. 2×4) may be used at the rail supporting brackets 16 and retaining flange 17 of each guard rail support 10 in order to firmly secure the upper and lower wooden guard rails 36,37 and kickboard 39 in place. As before, at the rail supporting brackets 16 and retaining flange 17 of each guard rail support 10, the upper and lower wooden rails 36,37 and kick board 39 may be secured to their corresponding short wooden stubs 35 and to the rail supporting brackets 16 and flanges 17 via suitable fasteners 23 such as nails or the like.

It will further be appreciated that the safety barrier configuration 50 depicted in FIG. 5 also represents the configuration present at the guard rail supports defining the ends of the safety barrier 40 constructed in accordance with the embodiment of FIG. 4. As can be envisioned, at each guard rail support defining an end of the safety barrier 40, there will be no overlapping wooden rail scheme at the rail supporting brackets 16 and retaining flange 17. Thus, short stubs of stock lumber (preferably of the same type used for the wooden rails) will be needed to firmly secure the wooden rails within their respective brackets and retaining flanges.

Figure 6:
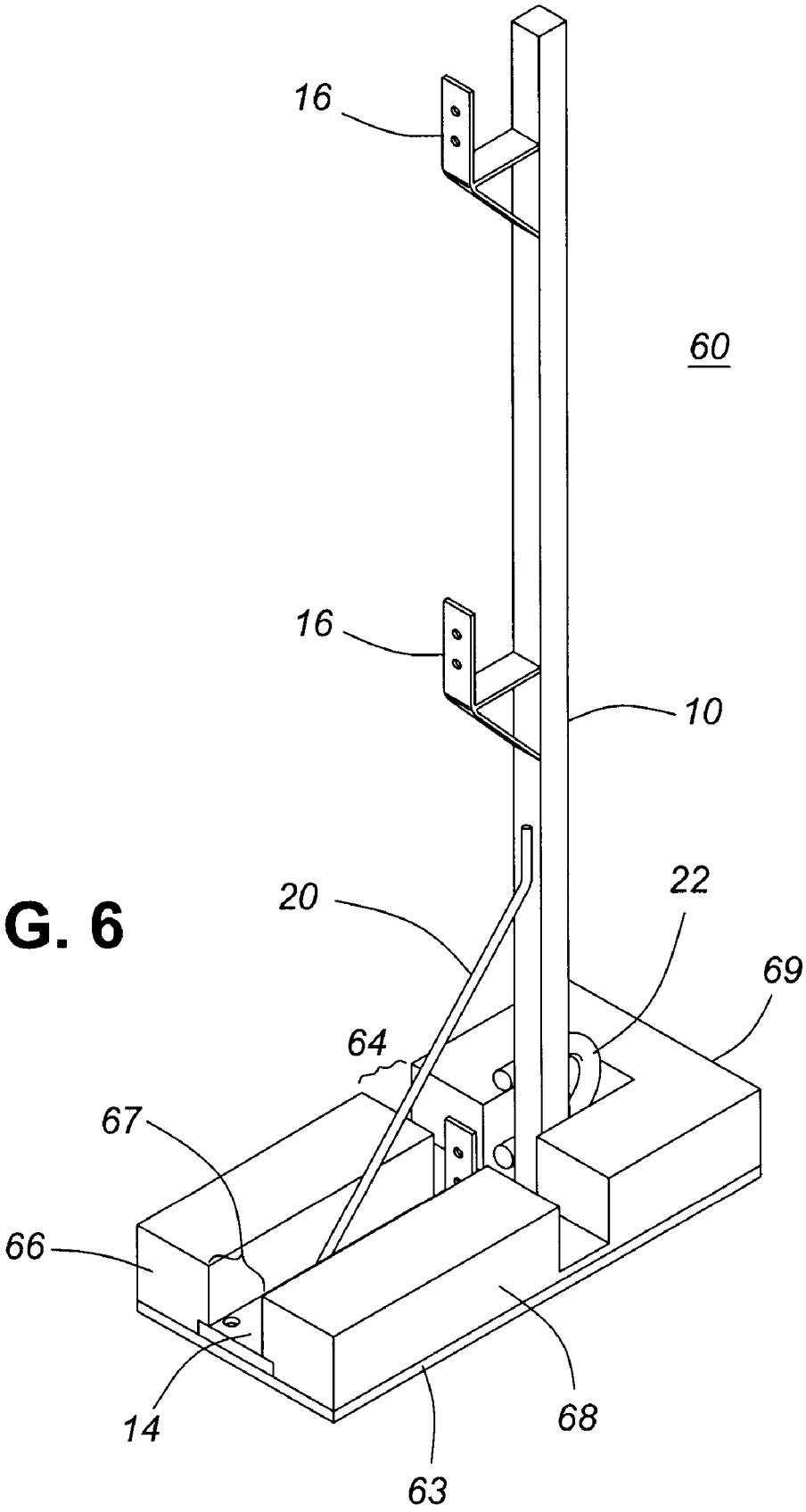
FIG. 6 is a perspective view of a portable guard rail support having a concrete-filled steel base in accordance with an alternate embodiment of the present invention.

FIG. 6 depicts a guard rail support 60 in accordance with a further aspect of the present invention. Again, like numerals are used to denote like features with the guard rail support 10 of FIGS. 1 and 2. As can be seen, the guard rail support 60 comprises the guard rail support 10 of FIGS. 1 and 2, slidably received within a concrete-filled steel base 68. The steel base 68 provides for greater stability and adequate support in cases where it is not possible, for whatever reason, to secure the base plate 14 of the guard rail support 10 to a floor surface via fasteners (e.g. expansion anchors or screws) placed through holes 24*a*, 24*b*. As shown, the concrete-filled steel base 68 is constructed so as to have a groove formed on the bottom surface thereof for slidably receiving the base plate 14 of the guard rail support 10. The groove extends to an open end 66 of the steel base 68 in order to provide means for allowing the guard rail support 10 to slide into the steel base 68. It will be appreciated that the groove terminates before reaching an opposite end 69 of the steel base 68 such that the guard rail support 10 may only be slidably received within and removed from the steel base 68 at the open end 66.

The concrete-filled steel base 68 has a first channel or cavity 67 formed along its central longitudinal axis and dimensioned accordingly to receive angular brace 20, retaining flange 17 and tie-off ring 22 of the guard rail support 10. Furthermore, the steel base 68 has a pass-through channel or cavity 64 formed therein proximal the flange 17 and dimensioned to correspond to the distance between the flange 17 and the upright column 12. The pass-through cavity 64 advantageously provides for pass-through of kick board rails (not shown), as appropriate.

In the embodiment of FIG. 6, the guard rail support 10 is securely maintained within the concrete-filled steel base 68 due to the precise tongue-groove type of fitting of the base plate 14 within the groove and the weight of the steel base 68. Advantageously, the substantial weight afforded by the concrete-filled base 68 provides the necessary stability and support to maintain the guard rail support 10 in a fixed and upright position. It will be appreciated that a resilient, non-slip pad 63 may also be fastened by suitable adhesive means to the underside of the concrete-filled steel base 68 to provide a frictional wear resistant non-slip surface for contacting and engaging a floor surface. A plurality of such guard rail supports 60 may then be located along the outer edge of a floor under construction and a safety barrier constructed in the manner shown by either of FIG. 4 or 5.

Figure 7:
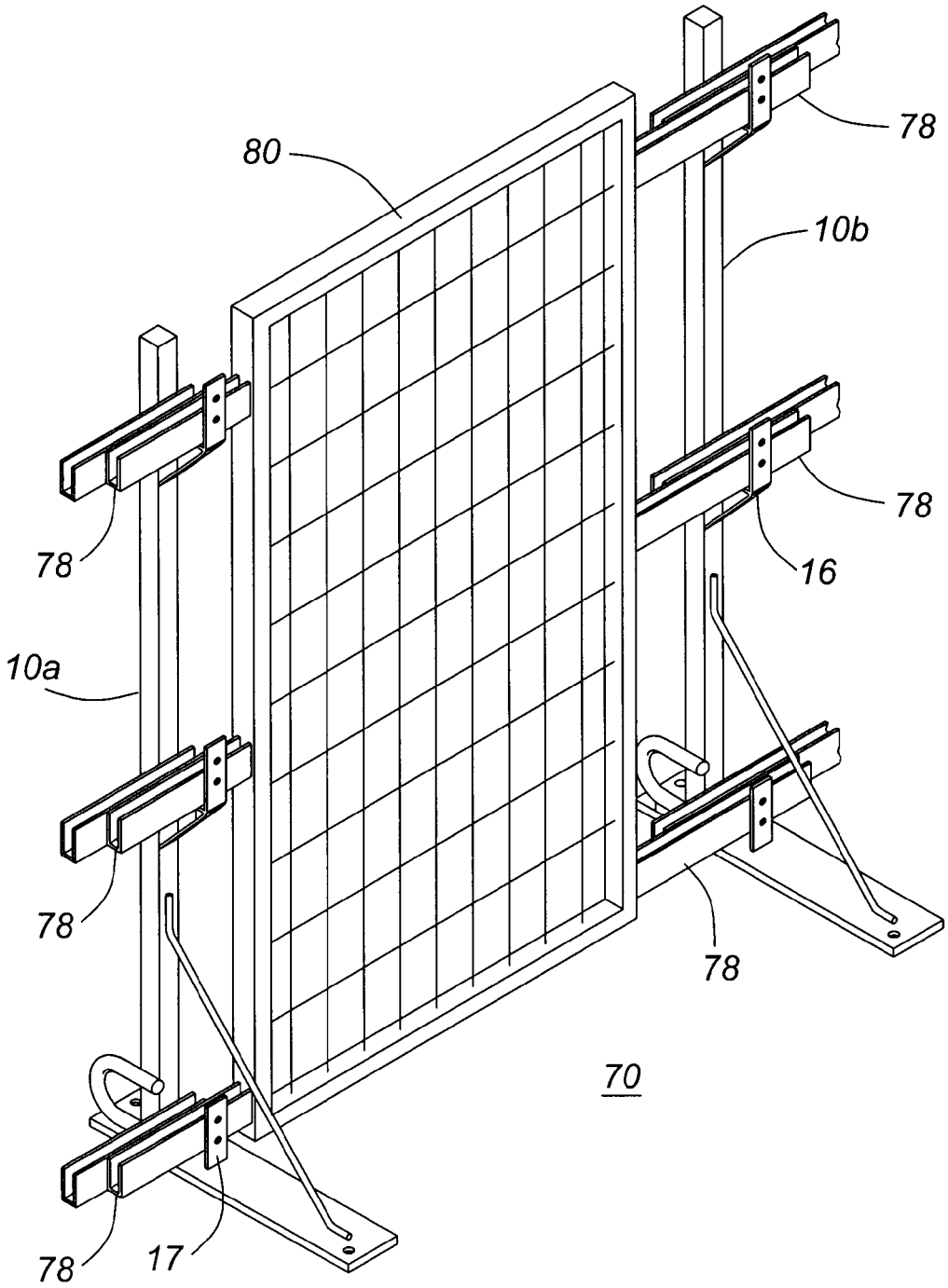
FIG. 7 depicts a portion of a safety barrier constructed with a safety mesh in accordance with a further aspect of the present invention.

In accordance with a further aspect of the present invention, a mesh-like fence structure may be used in conjunction with any of the guard rail supports 10 or 60 described in relation to FIGS. 1 and 2 or 6 to form a mesh-like (or fence) safety barrier at any desired site under construction. For example, a portion of a fence-like safety barrier 79 constructed in accordance with the present invention is depicted in FIG. 7. Again, like features are denoted by like numerals. As shown, a framed mesh 80 includes three projecting U-beams 78 affixed to opposite vertical sides thereof. The U-beams 78 are preferably made of metal and are supported and secured within the rail supporting brackets 16 and retaining flanges 17 of the guard rails supports 10*a*, 10*b* in the same overlapping manner as described in relation to FIG. 4. In this case, however, holes corresponding to the holes 19 of the rail supporting brackets 16 and retaining flanges 17 are pre-drilled into each U-beam. In this manner, two overlapping U-beams may be placed within the rail supporting brackets 16 and retaining flanges 17 of each guard rail support 10 and secured with suitable fasteners. Thus, in this particular embodiment, the rail supporting brackets 16 and retaining flange 17 of each guard rail support 10 are dimensioned so as to accommodate two adjacent and overlapping U-beams. It will be appreciated that the mesh-like structure 80 of FIG. 7 need not include three U-beams projecting from each side, as shown. Two projecting U-beams may provide for sufficient stability and support. In this case, a single rail supporting bracket along with the retaining flange would be used, as required.

The guard rail supports 10, 60 of the present invention each have two rail supporting brackets 16 affixed to their upright column 12 and a single retaining flange 17 affixed to their base plate 14 for supporting upper and lower wooden rails and kick boards, respectively. Although the retaining flange 17 on each guard rail support is a necessary requirement for supporting kick boards in accordance with safety standards and regulations, it will be appreciated that the precise number of rail supporting brackets 16 affixed to the upright column 12 of a given guard rail support is not material to the invention. Those skilled in the art will appreciate that construction safety regulations in most jurisdictions require guard rail systems of the type described to have a top rail, an intermediate rail and a toe or kick board as a minimum. Thus, at least two rail supporting brackets (for supporting upper and lower wooden guard rails) and a retaining flange (for supporting the kick board) are provided in the guard rail support of the present invention in order to adhere to safety regulations. However, more than two rail supporting brackets for supporting more than two rails in addition to the kick board may be employed in alternative embodiments without departing from the scope of the invention.

In addition, it will be appreciated that safety regulations in most jurisdictions require that the top rail of a guard rail barrier be located at least 3 feet but not more than 3.5 feet above the floor or ground surface to which the guard rail barrier is to be anchored while the intermediate rail be midway between the top rail and the floor surface. Thus, in a preferred embodiment of the present invention, the rail supporting brackets 16 are spaced along the upright column 12 of the guard rail support 10, 60 in such a manner so as to adhere to the above-prescribed safety regulations when fitted with upper and lower rails. In addition, safety regulations generally dictate that the top and intermediate rails be at least 1.5 inches by 3.5 inches in dimension and that the kick board be at least 3.5 inches in height. Advantageously, the rail supporting brackets 16 and retaining flange 17 of the guard rail support 10,60 of the present invention are preferably dimensioned so as to accommodate 2"×4" wooden rails, thereby conforming to safety regulations. It will be appreciated, however, that the rail supporting brackets and retaining flange may be dimensioned in any appropriate manner that meets the minimum safety guidelines in the jurisdiction of concern.

To further comply with safety regulations, it will be appreciated that the spacing between guard rail supports of the present invention when used in the construction of a safety barrier as described should not exceed approximately 8 feet. With regard to safety line anchorage points, most safety regulations specify that the anchorage must be capable of supporting a static load on the order of 17.8 kN (or 4000 lbs) in any direction, with proper provision to accept a safety line connection. Advantageously, the safety tie-off ring 22 of the guard rail support 10, 60 of the present invention has been tested to support a static load of 5000 lbs.

A guard rail system constructed with the guard rail support of the present invention provides for easy installation at, and removal from, sites under construction. As will be appreciated, installation may be accomplished by a single worker, if necessary. A first step in the installation procedure is to locate a plurality of supports 10 at spaced intervals up to eight feet long about the perimeter of a ground surface under construction and to attach the baseplate of each support to the ground surface using suitable fasteners or anchors. Once a series of supports according to the present invention are located and secured to the floor of a building under construction, the upper and lower safety rails may be individually placed and secured within the brackets of adjacent supports in the manner shown in FIG. 4, so that the rails extend completely about the perimeter of a floor under construction. Thus, the assembly of a safety guard rail fence or barrier, together with kick boards may be quickly mounted in place. An advantage of the preferred embodiment is that each support may be attached to the floor of an existing building structure prior to insertion of the wooden rails or safety fences, thereby minimizing weight and bulk so that a single worker may install a guard rail assembly without assistance from another worker. Additionally, once construction is completed, the disassembly of such a guard rail assembly as well as the removal of the guard rail supports, may also be carried our in an efficient manner.

Advantageously, the guard rail support and associated guard rail assembly of the present invention reduces or eliminates the liability which may result from inadequately reinstalled guard rails. Specifically, at sites under construction, workmen sometimes need to temporarily remove portions of a guard rail in order to gain access to certain regions. With prior art conventional wooden rail assemblies, the workmen typically just hammer out the appropriate section when required. Inherently lazy, however, workmen do not usually return the guard rails back to their original state, thereby compromising the integrity of the guard rail assembly and causing safety concerns. The guard rail support 10 of the present invention provides for a fast and efficient disassembling and reassembling of a portion of a guard rail assembly if need be. Furthermore, by preventing the damage of lumber which would ordinarily result from such crude hammering out, the inventive guard rail support prevents the possible reassembly of a hammered out portion of a guard rail assembly with damaged lumber. The all-steel construction of the guard rail support of the present invention also ensures durability and repeated use for many years, thereby providing a high return on investment and cost savings.

The temporary guard rail support and associated assembly of the present invention have been described in connection with the provision of a safety guard rail along the outer drop-off edge or perimeter of a concrete floor slab which defines an upper story level of a building while it is under construction; the principle purpose being to protect workmen on the floor slab from falls. It will be appreciated, however, that the guard rail support and assembly may be useful in other embodiments and a guard rail support embodying the principles of the invention may, if desired and with or without modification as required, be employed for guard rail support purposes in a wide variety of other situations or environments as, for example, in the provision of a temporary guard railing around the perimeter of a roof structure, along the sides of a bridge construction until such time as the permanent guard railings are installed, or along any drop-off edge wherever it may occur.

While preferred embodiments have been described and illustrated, it will be apparent to one skilled in the art that numerous modifications, variations and adaptations may be made without departing from the scope of the invention as defined in the claims appended hereto.

What is claimed is:

1. A guard rail support for use in erecting a temporary safety barrier comprising:

a substantially flat bottomed base plate;

an upright column affixed to said flat bottomed base plate;

at least one guard rail support bracket affixed to said upright column;

a kick-board retaining flange affixed to said flat bottomed base plate in spaced proximal relationship with a first side of said upright column;

an angular brace affixed to and angularly extending between said upright column and a distal end of said flat bottomed base plate on said first side of said upright column; and a safety tie-off ring affixed to said upright column and said flat bottomed base plate on a second side of said upright column opposite said first side, said safety tie-off ring being adapted to support a static load of at least 4000 lbs in any direction.

2. A guard rail support according to claim 1 wherein said substantially flat bottomed base plate has at least two holes formed therein for receiving anchors to secure said portable guard rail support to a ground surface.

3. A guard rail support according to claim 2 wherein said at least two holes are located proximal diagonally opposite corners of said substantially flat bottomed base plate.

4. A guard rail support according to claim 2 wherein said at least two holes are adapted to receive concrete expansion anchors.

5. A guard rail support according to claim 1 wherein said at least one guard rail support bracket and said retaining flange each have at least one hole formed therein for receiving fasteners to secure said at least one guard rail support bracket and said retaining flange to at least one guard rail and at least one kick-board, respectively.

6. A guard rail support according to claim 5 wherein each of said at least one hole is adapted to receive a fastener selected from the group consisting of nails, screws, and rivets.

7. A guard rail support according to claim 1 wherein said retaining flange is spaced a sufficient distance apart from said upright column so as to accommodate at least one kick-board.

8. A guard rail support according to claim 1 wherein said retaining flange is spaced a sufficient distance apart from said upright column so as to accommodate two overlapping kick-boards.

9. A guard rail support according to claim 1 wherein said at least one guard rail bracket is an L-shaped bracket.

10. A guard rail support according to claim 9 wherein said at least one L-shaped bracket has vertical and horizontal dimensions for fixedly receiving at least one guard rail.

11. A guard rail support according to claim 9 wherein said at least one L-shaped bracket has ertical and horizontal dimensions for fixedly receiving two overlapping guard rails.

12. A guard rail support according to claim 1 further comprising a concrete-filled steel base adapted to receive said portable guard rail support, said steel base having a retaining groove formed in a bottom surface therein for slidably receiving said substantially flat bottomed base plate of said portable guard rail support, said steel base further having a first channel integrally formed therein extending from a top surface of said steel base to said retaining groove, said first channel in parallel relation to said retaining groove and dimensioned to receive said safety tie-off ring, said upright column, said kick-board retaining flange, and said angular brace when said substantially flat bottomed base plate is slidably received in said retaining groove, said steel base further having a second channel integrally formed therein extending from said top surface of said steel base to said retaining groove, said channel in perpendicular relation to said retaining groove and dimensioned to receive at least one kick-board for placement between said kick-board retaining flange and said upright column.

13. A guard rail support according to claim 12 wherein said steel base further comprises a non-slip pad secured to said bottom surface thereof.

14. The guard rail support according to claim 1, wherein the safety tie-off ring is adapted to support a static load of at least 5000 lbs in any direction.

15. A portable safety barrier for use about a drop-off edge of a floor surface, said portable safety barrier comprising at least first and second portable guard rail supports located in spaced relation to one another along said drop-off edge, each of said first and second portable guard rail supports comprising:

a substantially flat bottomed base plate;

an upright column affixed to said substantially flat bottomed base plate;

at least one guard rail support bracket affixed to said upright column;

a kick board retaining flange affixed to said substantially flat bottomed base plate in spaced proximal relationship with a first side of said upright column;

an angular brace affixed to and angularly extending between said upright column and a distal end of said substantially flat bottomed base plate on said first side of said upright column;

a safety tie-off ring affixed to said upright column and said substantially flat bottomed base plate on a second side of said upright column opposite said first side, said safety tie-off ring being adapted to support a static load of at least 4000 lbs in any direction; and wherein said at least one guard rail support bracket and said kick board retaining flange of said first and second portable guard rail supports fixedly retain guard rails and kick boards.

16. The portable safety barrier according to claim 15, wherein the safety tie-off ring is adapted to support a static load of at least 5000 lbs in any direction.

* * * * *